343-909 SR
3/5/85 XR 4,503,379

United States Patent [19]

Raiman

[11] Patent Number: 4,503,379

[45] Date of Patent: Mar. 5, 1985

[54] ROTATION OF MICROWAVE SIGNAL POLARIZATION USING A TWISTABLE, SERPENTINE-SHAPED FILAMENT

[75] Inventor: Clifford Raiman, Roselle, Ill.

[73] Assignee: Chaparral Communications, Inc., San Jose, Calif.

[21] Appl. No.: 484,255

[22] Filed: Apr. 12, 1983

[51] Int. Cl.[3] ..... H01P 1/165

[52] U.S. Cl. ..... 333/21 A; 343/909

[58] Field of Search ..... 333/21 R, 21 A, 140, 333/161; 343/786, 909

[56] References Cited

U.S. PATENT DOCUMENTS 2,628,278 2/1953 Zaleski ..... 333/21 A X 3,296,558 1/1967 Bleackley ..... 333/21 A

*Primary Examiner*—Paul L. Gensler

*Attorney, Agent, or Firm*—F. D. LaRiviere

[57] ABSTRACT

A continuously-variable septum for rotation of electric field polarization in a circular waveguide comprising a continuous, serpentine-shaped, electrically conductive filament.

10 Claims, 5 Drawing Figures

ROTATION OF MICROWAVE SIGNAL POLARIZATION USING A TWISTABLE, SERPENTINE-SHAPED FILAMENT

BACKGROUND OF THE INVENTION

Radio waves are characterized in one respect by the way they are polarized, where polarization of a wave is defined as the orientation of the polarity or rotation direction of the electric field. Linear polarization may be horizontal, vertical, or at various angles between the two with respect to the earth's axis or surface. Radio waves also may be circularly polarized either right- or left-hand circular, where the electric field vector rotates in that direction at the rate of the signal frequency.

Standard AM broadcast waves typically have been vertically polarized with respect to the earth. FM broadcast as well as VHF and UHF TV signals are normally horizontally polarized in the United States, but in recent years some applications have used circular polarization in these services. Two-way radio mobile communications such as police, taxi, etc., normally employ vertical polarization.

In the microwave portion of the electromagnetic spectrum, for applications where signals are relayed from tower to tower (e.g., transcontinental microwave links), antennas are oriented for either horizontal or vertical polarization. This method provides improved discrimination between circuits. In addition, dual polarization is often employed on a single antenna in order to obtain twice the normal signal processing capacity available from an antenna with only one polarization.

For satellite communications, both horizontal and vertical polarization is often used on the same satellite, again to double the number of transponders available. A good example of the use of dual polarization on a satellite is the RCA SATCOM IIIR operating in the 4000 MHz region with 24 transponders. The twelve odd numbered transponders (1, 3, 5, etc. . . . ) utilize vertical polarization and the twelve even numbered (2, 4, 6, etc. . . . ) use horizontal polarization. This method of polarization change between adjacent transponders acts to produce increased discrimination and reduces interference that might cause deterioration of the signal from the desired transponder.

At a receiving site on the earth, the "earth station", it is necessary to adjust the receiving antenna's polarization to correspond to that of the transponder from which it is desired to receive signals. Therefore, if the earth station antenna is horizontally polarized and aimed at Satcom IIIR, only the even numbered transponders will be received. Conversely, if the antenna is vertically polarized, then the odd ones will be received. Some earth station antennas have "dual polarized" feeds which are capable of receiving both polarizations simultaneously and thus can receive any or all of the 24 transponders with no further adjustment of the antenna (feed).

Unfortunately, the components required to provide the dual polarized capability for an earth station antenna are expensive, and In some applications, such costs cannot be absorbed by the market. Competition will not withstand the added costs of this equipment.

In the personal earth station market, antennas should be capable of receiving television programs from all of the domestic satellites (domsats) and from all of the transponders on each of the satellites. Thus, the antenna must be capable of responding to either horizontal polarization or vertical, as the case may be, and for some satellites, which have their polarization(s) skewed, the antenna must respond to polarization which is displaced somewhat from truly horizontal or vertical polarization.

The personal earth station market is relatively new. Early designs, utilized a motor driven feed arrangement wherein the entire feed mechanism was rotated physically around the axis which extends from the center of the reflector dish to the focal point. The motor driven mechanism was usually a standard TV antenna rotator easily available on the market and usually designed for outdoor applications and therefore weatherproof. The powered rotator is controlled via a cable which is run to the receiver location. The antenna polarization is typically adjusted at the TV set for best picture as the receiving antenna polarization is driven to coincide with that of the satellite and associated transponder polarization desired.

Since the typical feed assembly for the reflector consists of a feed horn, a section of waveguide, and a low noise amplifier (LNA) plus associated cable, the structure becomes unwieldy and bulky, and difficult to assemble and maintain. In addition, unless great care is taken to have a mechanism which runs true with respect to the axis of rotation, any wobble of the feed horn during rotation will cause the antenna beam to depart from true boresight along the focal axis, and the signal from the satellite will not be in the maximum of the receiving antenna pattern. The quality of TV pictures is therefore degraded. In addition, as actual field installations age, such systems are far from trouble-free, and usually require much repair and maintenance over time.

A far superior arrangement results if the feed horn assembly could be mounted permanently in a fixed position, never to be rotated mechanically. This would eliminate the problem of boresight errors in beam aiming as well as the problems associated with maintenance of mechanical rotators over long periods of time.

The distribution of the electric field within circular waveguide 10 when operating in the dominant TE 1,1 mode is shown in FIG. 1. The lines of electric field, although generally curved symmetrically, are all normal to a plane which passes through the horizontal diameter of the waveguide and extends longitudinally through the waveguide. The horizontal plane can be depicted as a "septum" which in fact can be made of a conducting material such as copper or brass and placed in the waveguide without disturbing the proper operation of the guide. Thus septum 12 will not block or attenuate the wave nor will it cause reflections to occur so long as it is a relatively thin conducting sheet. The septum can be of any length and the wave as it travels through the guide will reform after it has passed by the septum into a wave identical to the original wave. This phenomenon occurs because the electric field lines are at all points perpendicular (normal) to septum 20 and in effect do not "see" the conducting sheet. The wave is said to be cross polarized with respect to the septum.

Another configuration which is functionally identical to the septum or continuous conducting sheet comprises spaced diametric conducting pins which are mounted across the diameter of the circular waveguide in the same plane as the previous septum and spaced along the longitudinal axis of the guide in relatively close proximity. Pin spacings of small fractions of a wavelength can be used. The pins perform the same function with respect to wave propagation as described above for the septum.

If the position of each of the pins described above is rotated slightly around the axis of the circular waveguide, the polarization of the electric field associated with each pin's position therein will tend to remain orthogonal to the pin. If the rotation of each pin is small (a few degrees) so as not to introduce large discontinuities into the structure, a gradual rotation of the polarization will begin and will not upset wave propagation in the waveguide. Such pin configuration is well known and described in greater detail in U.S. Pat. No. 3,864,688. Other methods in the prior art for rotating the polarization of high frequency signals is shown in U.S. Pat. Nos. 3,024,463, 3,599,219 and 3,720,947.

Obviously, in order to adjust the fixed pin configuration described in U.S. Pat. No. 3,864,688 to the polarization of the incident wave from any transponder on any satellite, the entire feed assembly again must be rotated. If the pins themselves are rotated as described in U.S. Pat. Nos. 3,287,729 and 3,296,558, the need for rotating the entire feed assembly is obviated.

SUMMARY OF THE INVENTION

Although rotation of electric field polarization by continuous adjustment of diametric pins in a fixedly mounted feed assembly while maintaining pin spacing and successively small progression of pin-to-pin rotation is known, it is cumbersome mechanically and expensive to produce. In the present invention, the septum comprises a continuous, a serpentine-shaped, electrically-conductive filament. Such a filament is rugged, inexpensive to produce and easily mounted inside most existing circular waveguides.

The filament comprises a series of interconnected legs for transverse orientation to wave propagation at the diameter of a circular waveguide, each leg being approximately equal in length but slightly less than the diameter of the waveguide. The filament terminates in a leg at each end. One end leg of the filament is rigidly mounted to the wall of the desired waveguide input to the LNA, and the other end is securely fastened to a rotatable sleeve or other system for rotating that end leg around the longitudinal axis of the waveguide. Thus, the only driven element is the leg nearest the aperture of the feed.

The serpentine shape of the filament at once assures accurate leg-to-leg spacing and successively small progression of leg-to-leg rotation. By appropriate selection of a resilient material, rotation of the legs of the filament is repeatable and

DESCRIPTION OF THE PREFERRED EMBODIMENT

Figure 1:
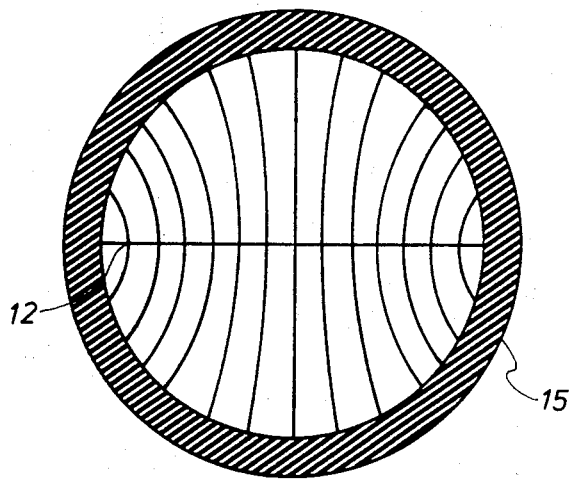
FIG. 1 is a schematic illustration of the orientation of electric field polarity of a signal propagating in a circular waveguide.
Figure 2:
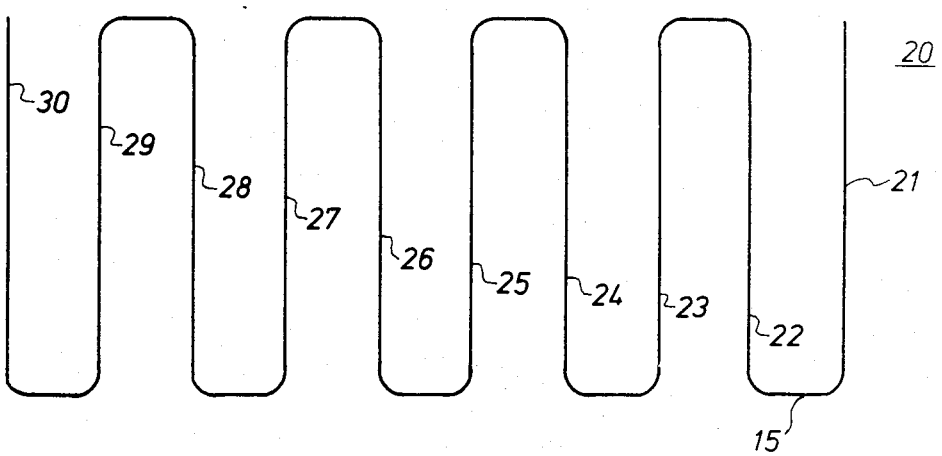
FIG. 2 is a top view of a septum for rotation of signal polarization constructed according to the principles of the present invention.

A septum for continuously variable rotation of the polarization of a microwave signal constructed according to the present invention is shown in FIG. 2. Septum 20 comprises a serpentine-shaped, electrically conductive filament having legs 21 through 30 connected to each other at one end by leg interconnections shown typically at 15. The filament may be formed of any electrically conductive material which retains resilience upon deformation which does not exceed its elastic limit. The preferred embodiment was constructed of 0.065 inch half-hard brass rod.

Septum 20 is formed in one plane, legs 21 through 30 being interconnected and long enough to form a septum having a width approximately equal to the diameter of the circular waveguide to be used. The width of the septum formed by filament 20 should not, however, be wide enough to contact the inside of the walls of the circular waveguide.

Leg interconnections 15 determine leg spacing and maintain relative angular displacement from leg-to-leg when rotated. Leg spacing varies with frequency of signals to be received. For present-day satellite signals, the spacing is may be $\frac{1}{8}''$ to $\frac{3}{8}''$, where the narrower spacing produces better results.

Figure 3:
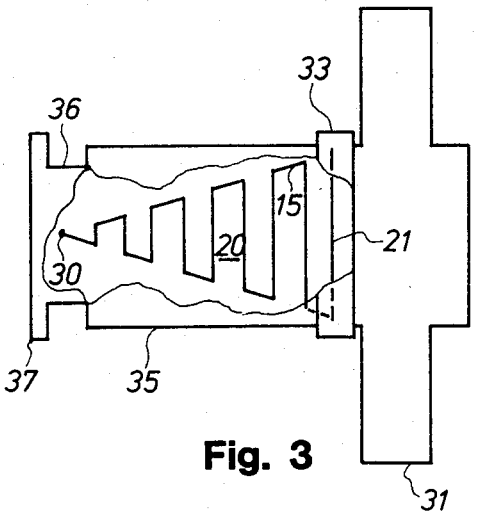
FIG. 3 is a cut-away view of a typical feed assembly including circular waveguide, feed horn and $\frac{1}{4}$-wave transformer, and incorporating the septum of FIG. 2.
Figure 4:
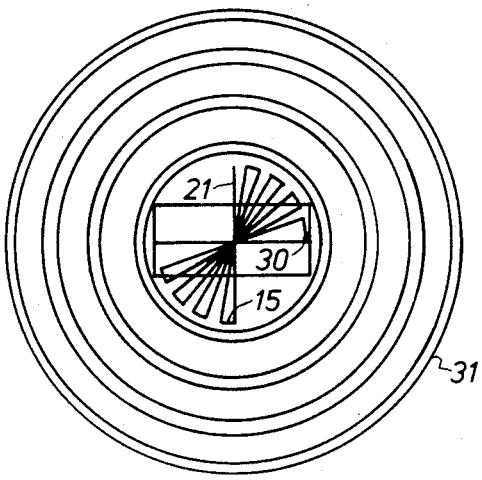
FIG. 4 is a front view of the feed assembly of FIG. 3.
Figure 5:
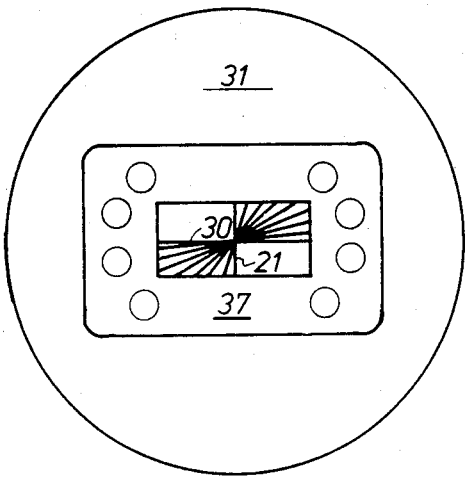
FIG. 5 is a rear view of the feed assembly of FIG. 3.

Referring now to FIGS. 3, 4 and 5, septum 20 is mounted in circular waveguide 35. Circular waveguide 35 is coupled to feed horn 31, $\frac{1}{4}$-wave transformer 36 and rectangular waveguide flange 37. Filament leg 30 of septum 20 is rigidly affixed parallel to the long dimension of the rectangular waveguide opening provided by $\frac{1}{4}$-wave transformer 36. Thus, leg 30 fixes the polarity of the received signal in the desired orientation for propagation in the rectangular waveguide.

Referring to FIG. 3, each leg 21 through 30 inclusive is substantially the same length. The apparent taper of septum 20 in FIG. 3 is intended to depict a continuous, substantially uniform, twist of septum 20 from end-leg 21 to end-leg 30.

Leg 21 is securely mounted to sleeve 33, which may be independent structure or part of feedhorn 31. In either configuration, sleeve 33 is coaxially mounted on waveguide 35 and free to rotate with respect thereto. However, leg 21 may be disposed at or behind aperture 32 of feedhorn 35. Therefore, sleeve 33 may be mounted behind or ahead of feedhorn 31. If mounted behind feedhorn 31, or any place along the length of waveguide 35, slots (not shown) must be provided in waveguide 35 to accommodate connection of leg 21 to sleeve 33. If sleeve 33, or equivalent structure for rotating leg 21, is mounted at the aperture of the feedhorn, then no slots are needed.

As sleeve 33 is rotated, leg 21 of filament 20 is correpondingly rotated around the longitudinal axis of circular waveguide 35. Legs 22 through 29 follow such rotation in approximately equal angular incremental rotations as required. Rotational forces are transmitted to legs 22 through 29 through interconnections 15 to form a twisted septum which rotates the polarization of the electric field in circular waveguide 35.

If septum 20 is constructed of half-hard brass rod or other similar material, it is resilient and tends to hold its proper position in circular waveguide 35 as restorative forces equal the forces of rotation applied by sleeve 33.

Leg 21 is the only driven element of the septum, thus providing a rugged and mechanically simple device for rotating microwave signal polarization. Rotation of +or−60° for a total rotation of 120° can be achieved with the configuration shown in FIGS. 3 through 5. However, if more total rotation is required (even as much as +or−90°), more legs should be added to the filament to avoid introducing undesirably large leg-to-leg displacement when rotated.

Sleeve 33 may be manually rotated or driven by a remotely-controlled motor in any number of ways. For example, the outer circumference of sleeve 33 could be formed to include a v-groove for coupling to a v-belt driven by such a motor. The apparatus for rotating sleeve 33 and the coupling of such apparatus thereto is not within the scope of this invention.

As noted earlier in this specification, the polarization of signals transmitted by some satellites may be skewed from true horizontal or vertical. In order to provide full range of polarization adjustment and assure that the range is adequate to coincide with the orientation of polarization of incident signals, the feed assembly may be mounted such that the long dimension of the rectangular opening of the ¼-wave transformer is oriented 45° from vertical. For approximately vertical or horizontal polarization of incident signals, leg 21 need be rotated only about 45° either clockwise or counterclockwise to receive the incident signal. The incident signal is then rotated approximately 45° by septum 20 to enter the rectangular opening of the ¼-wave transformer in proper orientation. If the feed assembly is mounted at a 45° angle, septum 20 can be shorter since typically its rotation would be limited to approximately +or−45° to 55° of rotation.

While septum 20 of the present invention is ideally suited for rotating polarization of signals transmitted from earth satellites, it also can be employed as a fixed septum in microwave antennas would provide dual polarization in their feed assembly configuration. Since rotation of the septum would not be required in such an application, it need not be made of flexible, resilient material. In this application, the septum of present invention could be fabricated utilizing printed circuit technology.

It should also be noted that the septum of the present invention is not limited to any particular frequency of microwave signal. Legs 21 through 30 of septum 20 may be made longer or shorter for different diameter circular waveguides which are used in different antennae configuration.

In typical operation, two orthogonal TE 1,1 modes propagate in the circular waveguide of the present invention. The desired signal is received and rotated by septum 20. The signal orthogonal to the desired signal is reflected at or near aperture 32 by leg 21. In other polarized signal receiving devices, such as that described in U.S. patent application Ser. No. 322,446 now U.S. Pat. No. 4,414,516, the signal orthogonal to the desired signal may be reflected, but not by structure at the aperture, but rather by improper termination of the waveguide at the other end. After the present invention receives the desired signal and reflects the signal orthogonal thereto at or near aperture 32, septum 20 reinforces the received signal at every leg as it propagates along circular waveguide 35.

I claim:

1. Apparatus for rotating the polarization of a signal comprising:

a hollow, circular waveguide having signal receiving and signal transmitting ends;

rotatable mounting means coaxially mounted to the circular waveguide near the receiving and thereof;

a continuous, serpentine-shaped, electrically-conductive filament formed into a series of interconnected legs and having an end-leg at each end thereof, mounted in the circular waveguide such that the interconnected legs are transverse to the propagating signal therein at approximately the diameter thereof, one end-leg being fixedly mounted to the rotatable mounting means, and the other end-leg being rigidly affixed at the signal transmitting end of the circular waveguide;

the legs of the filament being selectively rotatable around the longitudinal axis of the circular waveguide in response to rotation of the rotatable mounting means.

2. Apparatus as in claim 1 wherein the filament further includes interconnecting means for interconnecting the legs thereof and for maintaining approximately equal relative angular displacement between adjacent legs as the rotatable mounting means is rotated.

3. Apparatus as in claim 1 wherein the interconnecting means substantially determine the amount of relative angular displacement between adjacent legs.

4. Apparatus as in claim 1 wherein signals having polarization orthogonal to the polarization of the signal are substantially reflected at the signal receiving end of the circular waveguide.

5. Apparatus as in claim 1 wherein said other end-leg sets the orientation of the polarization of the signal emitted from the signal transmitting end of the circular waveguide.

6. A method for rotating the polarization of a signal propagating in a circular waveguide having signal receiving and signal transmitting ends, said method comprising the steps of:

coaxially mounting rotatable mounting means to the circular waveguide near the receiving end thereof;

forming a continuous, serpentine-shaped, electrically conductive filament, having a series of interconnected legs and an end-leg at each end thereof;

mounting the filament in the circular waveguide such that the interconnected legs are transverse to the propagating wave therein at approximately the diameter thereof;

rigidly affixing one end-leg to the rotatable mounting means and the other end-leg at the signal transmitting end of the circular waveguide; and rotating the rotatable mounting means for selective rotation of the legs of the filament around the longitudinal axis of the circular waveguide.

7. The method as in claim 6 further including the step of maintaining approximately equal relative angular displacement between adjacent legs as the rotatable mounting means is rotated.

8. The method as in claim 6 wherein the filament further includes interconnecting means for interconnecting, and for substantially determining the amount of angular displacement between, adjacent legs.

9. The method as in claim 6 further including the step of reflecting signals having polarization orthogonal to the polarization of the signal at the signal receiving end of the circular waveguide.

10. The method as in claim 6 further including the step of setting the polarization of the signal at the signal transmitting end of the circular waveguide.

* * * * *